US007096858B2

(12) United States Patent
Ohhashi et al.

(10) Patent No.: US 7,096,858 B2
(45) Date of Patent: Aug. 29, 2006

(54) AIR PUMP FOR INTERNAL COMBUSTION ENGINE

(75) Inventors: Hironori Ohhashi, Atsugi (JP); Hajime Hosoya, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/926,354

(22) Filed: Aug. 26, 2004

(65) Prior Publication Data

US 2005/0045161 A1 Mar. 3, 2005

(30) Foreign Application Priority Data

Aug. 27, 2003 (JP) ..... 2003-302379

(51) Int. Cl.
*F02M 37/08* (2006.01)
*F02M 37/20* (2006.01)

(52) U.S. Cl. ..... 123/516; 123/518

(58) Field of Classification Search ..... 123/516–520, 123/198 D; 73/40, 46, 118.1
See application file for complete search history.

(56) References Cited

U.S. PATENT DOCUMENTS 6,283,097 B1 * 9/2001 Cook et al. ..... 123/520
2002/0162457 A1 * 11/2002 Hyodo et al. ..... 96/109
2005/0044939 A1 * 3/2005 Kobayashi et al. ..... 73/118.1

FOREIGN PATENT DOCUMENTS

JP 2003-13810 A 1/2003

OTHER PUBLICATIONS

U.S. Appl. No. 10/926,355, filed Aug. 26, 2004, Ohhashi et al.
U.S. Appl. No. 10/932,046, filed Sep. 2, 2004, Ohhashi et al.

* cited by examiner

*Primary Examiner*—Mahmoud Gimie
(74) *Attorney, Agent, or Firm*—Foley & Lardner LLP

(57) ABSTRACT

A motor and a pump in an air pump pressurizing a fuel vapor passage of a fuel vapor purge system, are disposed in a case which is partitioned into a chamber accommodating the motor and a chamber accommodating the pump, to transmit a driving force of the motor to the pump by a magnetic coupling.

3 Claims, 3 Drawing Sheets

AIR PUMP FOR INTERNAL COMBUSTION ENGINE

FIELD OF THE INVENTION

The present invention relates to an air pump for an internal combustion engine suitable as an air pump for pressurizing or depressurizing the inside of a fuel vapor passage of a fuel vapor purge system, for example.

RELATED ART

Japanese Unexamined Patent Publication No. 2003-013810 discloses a diagnosis apparatus for diagnosing whether or not the leakage occurs in a fuel vapor passage of a fuel vapor purge system.

In this diagnosis apparatus, the fuel vapor passage is shielded by means of a valve, and the shielded section is supplied with air by an air pump, to be pressurized.

Then, based on a driving load of the air pump, it is judged whether or not the leakage occurred in the fuel vapor passage.

Since the air pump is used for the purpose of transferring air, it is not provided with an airtight structure for sealing in airtight a motor from the transferred air.

Therefore, in the case of pressurizing the inside of the fuel vapor passage, sometimes, the fuel vapor flows back to reach the motor.

There is a possibility that the fuel vapor reached the motor corrodes a circuit portion of the motor, and the fuel vapor catches fire from a spark generated by the motor.

SUMMARY OF THE INVENTION

The present invention has an object to prevent the volatile matter, such as fuel vapor, from reaching a motor, to avoid the corrosion of a circuit portion or the burning of the volatile matter, in an air pump for an internal combustion engine.

In order to achieve the above object, according to the present invention, in an air pump for an internal combustion engine, comprising a motor and a pump driven by the motor, an airtight structure is disposed for sealing in airtight the inside of the motor from an outer space.

Further, according to the present invention, in an air pump for an internal combustion engine, comprising a motor and a pump driven by the motor, an airtight structure is disposed for preventing the leakage out of an air passage of the pump into an outer space.

Furthermore, according to the present invention, in an air pump for an internal combustion engine, comprising a motor and a pump driven by the motor, an airtight structure is disposed for sealing in airtight the motor from the pump.

The other objects and features of this invention will become understood from the following description with reference to the accompanying drawings.

DESCRIPTION OF EMBODIMENTS

Figure 1:
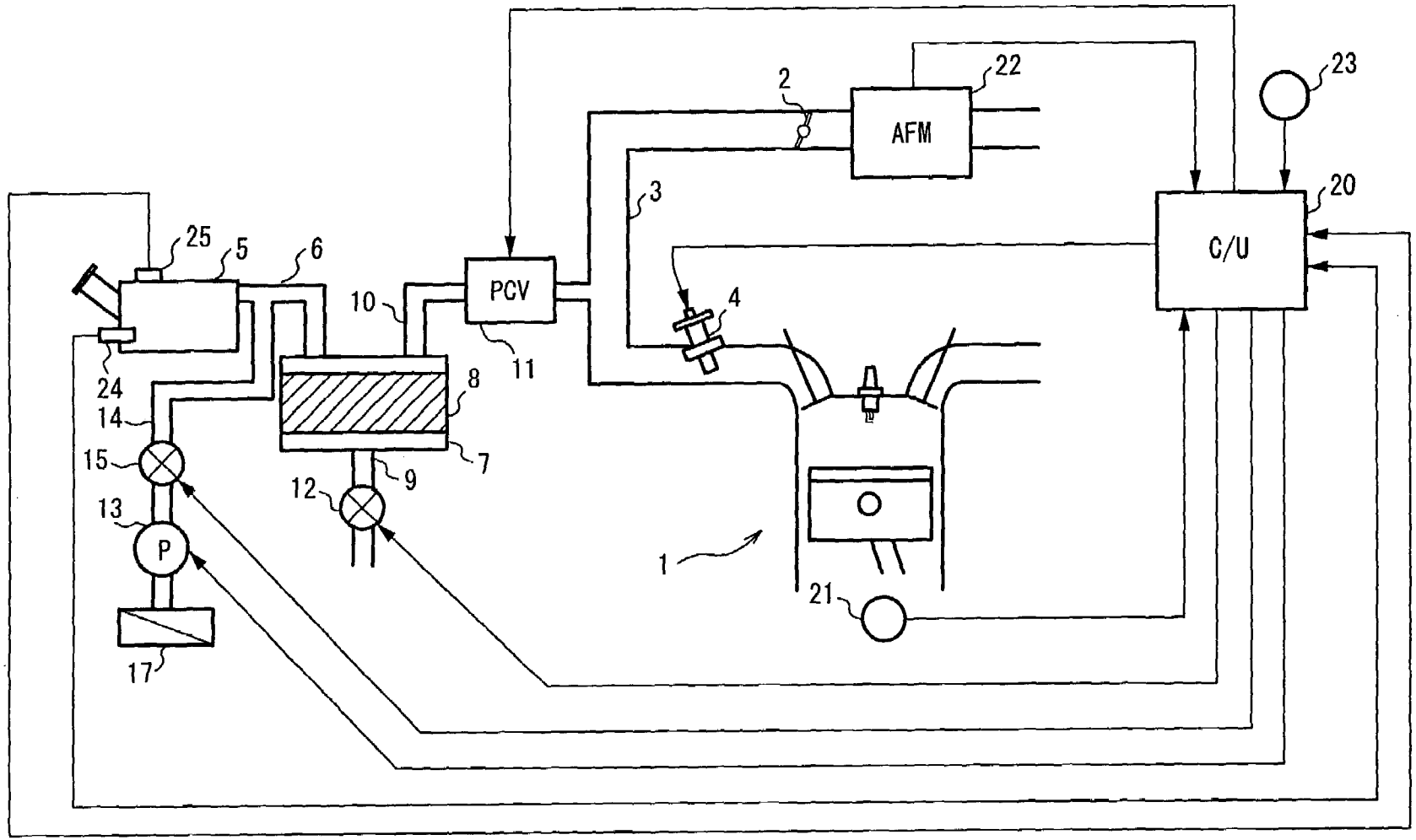
FIG. 1 is a diagram showing an internal combustion engine in an embodiment.

An internal combustion engine 1 shown In FIG. 1 is a gasoline engine installed in a vehicle.

A throttle valve 2 is disposed in an intake pipe 3 of internal combustion engine 1.

An intake air amount of internal combustion engine 1 is controlled by throttle valve 2.

For each cylinder, an electromagnetic type fuel injection valve 4 is disposed in a manifold portion of intake pipe 3 on the downstream side of throttle valve 2.

Fuel injection valve 4 injects fuel based on an injection pulse signal output from a control unit 20 incorporating therein a microcomputer.

Internal combustion engine 1 is provided with a fuel vapor purge system.

Fuel vapor purge system comprises an evaporation passage 6, a canister 7, a purge passage 10 and a purge control valve 11.

Fuel vapor generated in a fuel tank 5 is trapped in the canister 7 via the evaporation passage 6. The canister 7 is a container filled with an adsorbent 8 such as activated carbon. Further, a new air inlet 9 is formed in the canister 7, and the purge passage 10 is connected to the canister 7.

Purge passage 10 is connected to intake pipe 3 on the downstream side of throttle valve 2 via purge control valve 11.

Purge control valve 11 is opened based on a purge control signal output from control unit 20.

When a predetermined purge permission condition is established during an operation of internal combustion engine 1, purge control valve 11 is controlled to open.

When purge control valve 11 is controlled to open, an intake negative pressure of internal combustion engine 1 acts on canister 7, so that the fuel vapor adsorbed to canister 7 is detached by the fresh air, which is introduced through new air inlet 9.

Purged gas inclusive of the fuel vapor detached from canister 7 passes through purge passage 10 to be sucked into intake pipe 3.

Control unit 20 incorporates therein a microcomputer comprising a CPU, a ROM, a RAM, an A/D converter and an input/output interface.

Control unit 20 receives detection signals from various sensors.

As the various sensors, there are provided a crank angle sensor 21 detecting a rotation angle of a crankshaft, an air flow meter 22 measuring an intake air amount of internal combustion engine 1, a vehicle speed sensor 23 detecting a vehicle speed, a pressure sensor 24 detecting a pressure in fuel tank 5, and a fuel level sensor 25 detecting a fuel level in fuel tank 5.

Further, a drain cut valve 12 for opening/closing new air inlet 9 and an air pump 13 for supplying air to evaporation passage 6 are disposed, for diagnosing whether or not the leakage occurred in a fuel vapor passage of the fuel vapor purge system.

A discharge port of air pump 13 is connected to evaporation passage 6 via an air supply pipe 14.

A check valve 15 is disposed in the halfway of air supply pipe 14.

Further, an air cleaner 17 is disposed on the inlet port side of air pump 13.

When a diagnosis condition is established, control unit 20 controls purge control valve 11 and drain cut valve 12 to close.

As a result, the fuel tank 5, the evaporation passage 6, the canister 7 and the purge passage 10 on the downstream of purge control valve 11, are shielded as a diagnosis section. Then, if air pump 13 is activated, the diagnosis section is pressurized. An occurrence of a leakage in the diagnosis section is then diagnosed based on a pressure change in the fuel tank 5 at the time when the diagnosis section is pressurized by air pump 13.

Note, it is possible to diagnose the occurrence of leakage, based on the pressure drop after the diagnosis section is pressurized up to a predetermined pressure.

Further, it is possible to diagnose the occurrence of leakage, based on a driving load of air pump 13 at the time when the diagnosis section is pressurized.

Moreover, it is possible that the pressure in the diagnosis section is reduced by sucking the air from the diagnosis section by air pump 13, to diagnose the occurrence of leakage, based on the pressure in fuel tank 5 or the driving load of air pump 13 at the time.

Next, a structure of air pump 13 will be described in detail.

Figure 2:
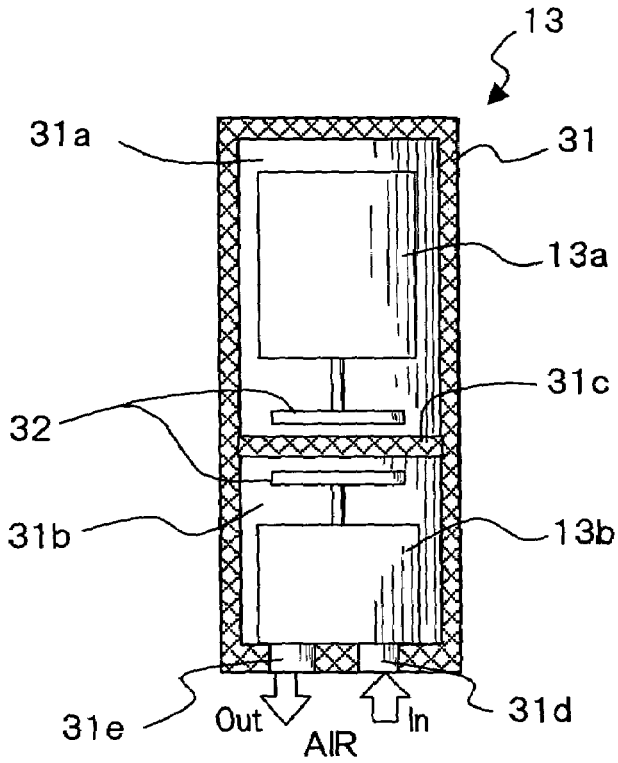
FIG. 2 is a diagram showing a first embodiment of an air pump.

FIG. 2 is a diagram showing a first embodiment of air pump 13.

As shown in FIG. 2, air pump 13 comprises a motor 13*a* and a pump 13*b* driven by motor 13*a*.

As pump 13*b*, a turbo pump or a rotary pump of positive displacement type can be used. However, in the present embodiment, a trochoid pump, which is one of gear pumps, is used.

Motor 13*a* and pump 13*b* are both disposed in a casing 31.

Casing 31 is partitioned into a chamber 31*a* accommodating motor 13*a* and a chamber 31*b* accommodating pump 13*b*, by a partition wall 31*c*.

The power from motor 13*a* to pump 13*b* is transmitted by a magnetic coupling 32.

Magnetic coupling 32 comprises a disk shaped magnet attached to an output shaft of motor 13*a*, and a disk shaped magnet attached to a rotation shaft of pump 13*b*, which are disposed opposite to each other via partition wall 31*c*, and the magnets attract each other, to transmit a rotation drive amount.

Here, since partition wall 31*c* serving as an airtight structure is disposed between motor 13*a* and pump 13*b*, the gas flow through is avoided between the motor 13*a* side and the pump 13*b* side.

On an end face of casing 31 on the side where pump 13*b* is accommodated, a suction opening 31*d* and a discharge opening 31*e* are formed.

Discharge opening 31*e* is connected with air supply pipe 14.

According to air pump 13 of the above configuration, for example, even if the fuel vapor flows back into pump 13*b*, it is prevented by partition wall 31*c* that the fuel vapor enters into chamber 31*a* accommodating motor 13*a*.

Accordingly, it is possible to avoid that a circuit portion of motor 13*a* is corroded by an influence of the fuel vapor or the fuel vapor catches fire from a spark.

Further, since the power is transmitted using magnetic coupling 32 being a non-contact joint, there is no need to seal a power transmission passage by a sealing member, and therefore, the airtightness is not reduced due to the deterioration of sealing member.

Note, as magnetic coupling 32, it is possible to use a cylinder shaped magnetic coupling other than the disk shaped magnetic coupling shown in FIG. 2, and accordingly, the structure of magnetic coupling 32 is not limited to the structure shown in FIG. 2.

Figure 3:
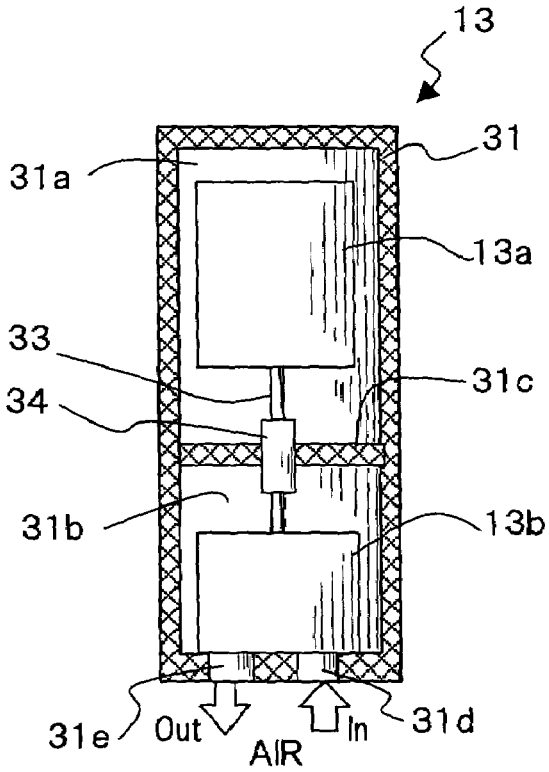
FIG. 3 is a diagram showing a second embodiment of the air pump.

FIG. 3 is a diagram showing a second embodiment of air pump 13.

In the second embodiment shown in FIG. 3, similar to the first embodiment, casing 31 is partitioned into chamber 31*a* accommodating motor 13*a* and chamber 31*b* accommodating pump 31*b* by partition wall 31*c* serving as the airtight structure, which is disposed between motor 13*a* and pump 13*b*.

However, the second embodiment differs from the first embodiment in that the power is transmitted from motor 13*a* to pump 13*b* using a shaft.

Namely, in the second embodiment, an output shaft 33 of motor 13*a* passes through partition wall 31*c*, to be extended into chamber 31*b* in which pump 13*b* is accommodated, thereby connecting output shaft 33 of motor 13*a* to the rotation shaft of pump 13*b*.

Further, a seal 34 is disposed on a portion where output shaft 33 passes through partition wall 31*c*, to prevent the leakage of fuel vapor out of a gap between the periphery of output shaft 33 and a hole of partition wall 31*c*.

As seal 34, a liquid seal, a labyrinth seal or the like is used.

Also in the second embodiment, even if the fuel vapor flows back up to pump 13*b*, it is prevented by partition wall 31*c* and seal 34 that the fuel vapor enters into chamber 31*a* in which motor 13*a* is accommodated.

Consequently, it is possible to avoid that the circuit portion of motor 13*a* is corroded by the influence of the fuel vapor or the fuel vapor catches fire from the spark.

Moreover, in the second embodiment, since a typical power transmission mechanism using a shaft is used, it is possible to avoid that the fuel vapor reaches motor 13*a*, without largely modifying the structure of air pump 13.

Figure 4:
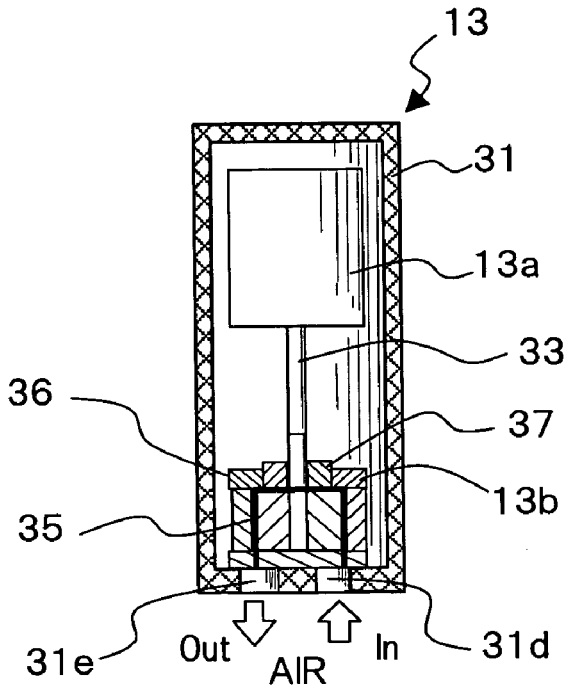
FIG. 4 is a diagram showing a third embodiment of the air pump.

FIG. 4 is a diagram showing a third embodiment of air pump 13.

In the third embodiment shown in FIG. 4, motor 13*a* and pump 13*b* are disposed in the same space within casing 31, and the power from motor 13*a* to pump 13*b* is transmitted by connecting a shaft between motor 13*a* and pump 13*b*.

Further, an airtight structure 35 is disposed in pump 13*b*, in order to limit an area into which the fuel vapor enters, to an air transfer passage in pump 13*b*, thereby preventing the leakage of fuel vapor into casing 31.

Airtight structure 35 comprises a sealing member 37 and a pump case 36.

Pump case 36 covers in airtight a rotating portion of pump 13*b*.

Sealing member 37 seals a portion where the rotation shaft of pump 13 passes through pump case 36, so that the fuel vapor can be prevented from leaking out of pump case 36 into casing 31.

Note, it is possible to attach sealing member to an inner side or an outer side of pump case 36.

It is prevented by sealing member 37 and pump case 36 that the fuel vapor, which flowed back into pump 13*b*, leaks exceeding a boundary shown by the bold line in FIG. 4.

Consequently, in the third embodiment, even if the fuel vapor flows back into pump 13*b*, the fuel vapor does not leak out of pump 13*b* into casing 31.

Therefore, it is possible to avoid that the circuit portion of motor 13*a* is corroded by the influence of the fuel vapor or the fuel vapor catches fire from the spark.

Figure 5:
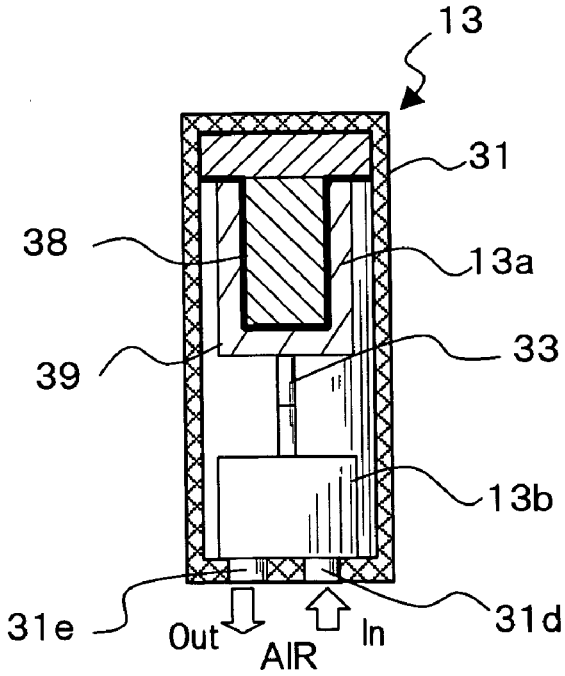
FIG. 5 is a diagram showing a fourth embodiment of the air pump.

FIG. 5 is a diagram showing a fourth embodiment of air pump 13.

In the fourth embodiment shown in FIG. 5, similar to the third embodiment, motor 13*a* and pump 13*b* are disposed in the same space within casing 31, and the power from motor 13*a* to pump 13*b* is transmitted by connecting a shaft between motor 13*a* and pump 13*b*.

However, in the fourth embodiment, an airtight structure 38 sealing the rotation portion and circuit portion of motor 13*a*, is disposed in motor 13*a*, so that the fuel vapor leaked into casing 31 via pump 13*b* does not invade into motor 13*a*.

Airtight structure 38 comprises a sealing member sealing a portion where the output shaft of motor 13*a* passes through a motor case 39, and motor case 39 covering in airtight the rotation portion and circuit portion of motor 13*a*.

Note, it is possible to attach the sealing member to an inner side or an outer side of motor case 39.

Airtight structure 38 prevents the fuel vapor entered into casing 31 via pump 13*b*, from invading into motor 13*a* exceeding a boundary shown by the bold line in FIG. 5.

Consequently, in the fourth embodiment, even if the fuel vapor flows back into pump 13*b* to leak into casing 31, the fuel vapor does not invade into motor 13*a*.

Therefore, it is possible to avoid that the circuit portion of motor 13*a* is corroded by the influence of the fuel vapor or the fuel vapor catches fire from the spark.

Note, the air pump having the structure shown in each of FIGS. 2 to 5, can be used for pressurizing or depressurizing the inside of the fuel vapor passage of the fuel vapor purge system, and also can be used as an air pump for supplying fuel atomization air to the fuel injection valve.

The entire contents of Japanese Patent Application No. 2003-302379 filed on Aug. 27, 2003, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

What is claimed is:

1. An air pump for an internal combustion engine comprising:

a motor;

a pump driven by said motor;

an airtight structure sealing in airtight said motor from said pump, wherein said airtight structure comprises:

a case accommodating said motor and said pump; and a partition wall partitioning said case into a space accommodating said motor and a space accommodating said pump; and a non-contact joint transmitting power from said motor to said pump.

2. An air pump for an internal combustion engine according to claim 1, wherein said non-contact joint is a magnetic coupling.

3. An air pump for an internal combustion engine according to claim 2, wherein said magnetic coupling comprises a disk shaped magnet attached to an output shaft of said motor and a disk shaped magnet attached to a rotation shaft of said pump, which are disposed opposite to each other via said partition wall.

* * * * *